US005634187A

United States Patent [19]

Ross

[11] Patent Number: 5,634,187

[45] Date of Patent: May 27, 1997

[54] AUTOMATIC SIMPLEX AND DUPLEX COPYING SYSTEM

[75] Inventor: Douglas A. Ross, Rochester, N.Y.

[73] Assignee: Xerox Corporation, Stamford, Conn.

[21] Appl. No.: 609,267

[22] Filed: Feb. 29, 1996

[51] Int. Cl.[6] ..... G03G 15/00

[52] U.S. Cl. ..... 399/365; 399/367

[58] Field of Search ..... 355/23, 24, 319, 355/320, 321, 316, 308, 309; 271/3.13, 3.15, 3.17, 4.02, 4.03, 10.02, 10.03, 65, 301; 399/363, 364, 3.1, 367, 369, 365, 373, 374

[56] References Cited

U.S. PATENT DOCUMENTS

| | | | |
|---|---|---|---|
| 4,330,197 | 5/1982 | Smith et al. . | |
| 4,459,013 | 7/1984 | Hamlin et al. | 355/23 |
| 4,468,114 | 8/1984 | Pels et al. | 355/24 X |
| 4,731,637 | 3/1988 | Acquaviva et al. | 355/317 |
| 4,947,217 | 8/1990 | Murakami et al. | 355/316 X |
| 5,026,044 | 6/1991 | Ryon et al. | 271/227 |
| 5,072,923 | 12/1991 | Coy | 271/110 |
| 5,078,378 | 1/1992 | Kapadia et al. | 271/3.1 |
| 5,337,135 | 8/1994 | Malachowski et al. | 355/319 |
| 5,488,458 | 1/1996 | Benedict et al. | 355/319 X |
| 5,502,542 | 3/1996 | Takano | 355/320 X |

FOREIGN PATENT DOCUMENTS

| | | | |
|---|---|---|---|
| 58-132253 | 8/1983 | Japan | 355/320 |

*Primary Examiner*—Matthew S. Smith

[57] ABSTRACT

In a simplex or duplex copier with plural different document inputs, including at least one input normally used for copying single documents and another normally used for copying plural documents, a system is provided for automatically selecting duplex copying whenever appropriate, to save copy sheets, including a controller programmed to automatically select between simplex or duplex copying and to direct the copy sheets into a duplex copying path when duplex copying is selected, and respective document input sensors connected to provide control signals to the controller upon sensing a document at a respective document input, the controller automatically selecting duplex copying unless there is a signal from a document input sensor at a document input normally used for copying single documents, such as a semi-automatic document input or a sensor sensing the lifting of the document handler, or, even though the document input normally used for copying plural documents is the input tray of an automatic recirculating document handler unit, a downstream sensor detects that only a single document was fed from that tray to be copied.

2 Claims, 1 Drawing Sheet

AUTOMATIC SIMPLEX AND DUPLEX COPYING SYSTEM

Figure 1:
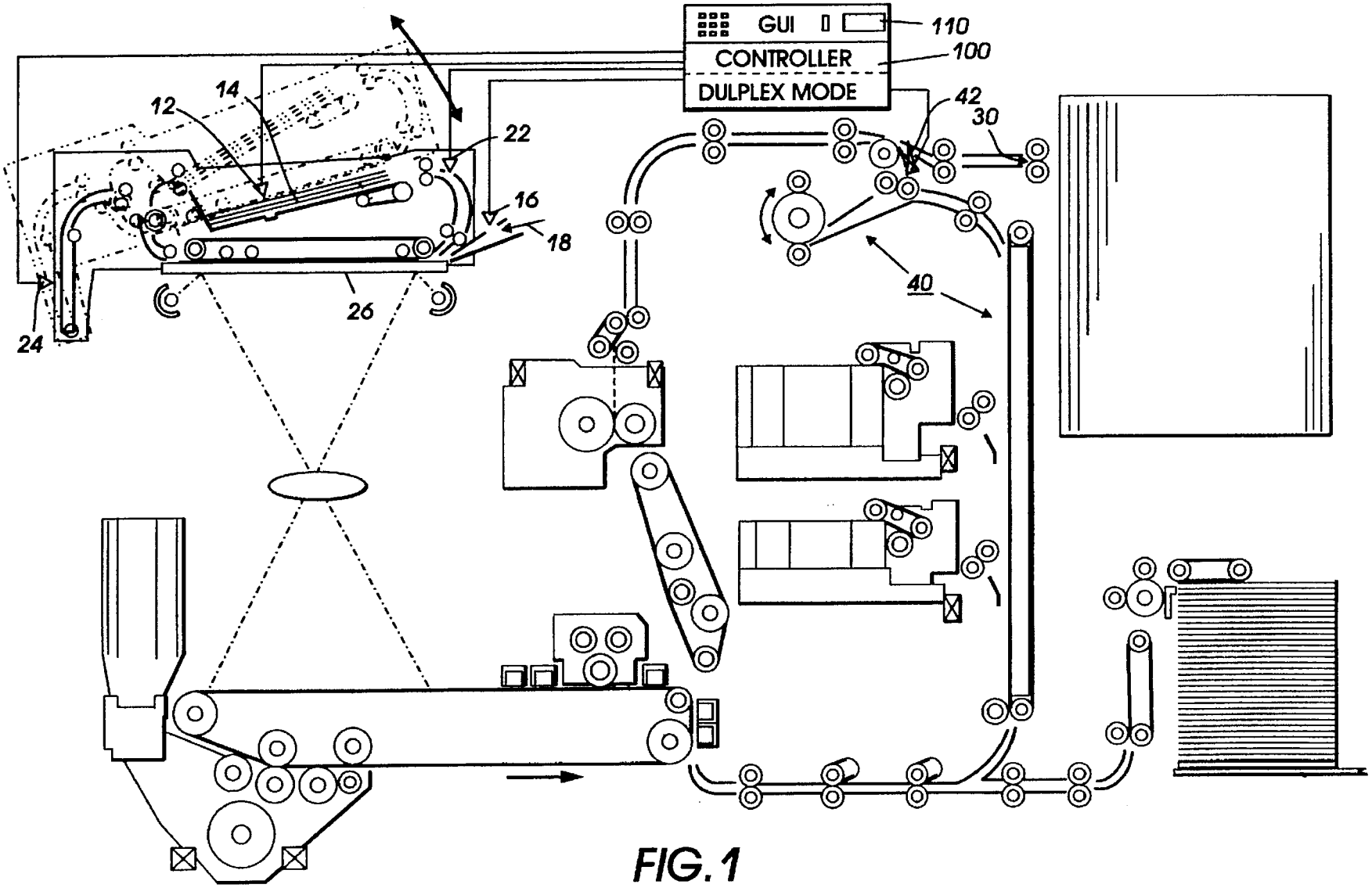

Disclosed in the embodiments herein is a low cost system for automatically doing duplex copying, when appropriate, without operator selection, to save copy paper and energy, yet not inappropriately trying to duplex copy single page documents.

Disclosed is a reproduction system for setting a reproduction machine automatically to a duplex copying mode where appropriate, thereby minimizing customer frustration as compared to having the machine being automatically preset to or defaulting to duplex copying for all modes of operation, even those modes where simplex or one sided copying should be used. Sensing of the document input system or device being utilized for the particular copying job automatically controls the selection of simplex or duplex copying of those documents. Thus, when the disclosed system is enabled, and a document input is made, the appropriate "Sides Copied" mode will be selected.

The present system can be implemented at low cost, utilizing existing or conventional document handlers and document input sensors and duplex copying paths with little or no wiring or hardware changes.

A 1997 "Energy Star" regulatory requirement for copiers equipped with automatic duplexing capability is that the default mode of operation, as set at the place of manufacture, should be to normally make duplex copies. Many customers, however, will find this automatic default annoying, if used for every copying mode, since, in copying a single sheet one sided (simplex) original, (typically done by using a manual platen copying mode or a semi-automatic document handler input), the resultant attempted duplex copy will be left stuck in the duplex paper path, in a duplex tray or wait station. That is, the copier is left waiting for a second side of the original or another second page to be copied on the opposite side of that duplex copy sheet, which second page does not exist in such a case of a single sheet simplex original. To retrieve such a copy will require pressing the "start print" button for a blank page copy with the platen cover closed, or removing the paper from the duplex tray by a purge or other extra step and control function. Attempted duplex copying of simplex single originals can also cause background contamination of toner on the blank backside of such simplex jobs attempted to be printed as duplex jobs.

An alternative to the above is for the tech rep or customer to reprogram or reset in non-volatile memory (NVM) the default on the machine back to the (heretofore normal) simplex default of 1-1 (simplex copies of simplex originals), unless, of course, duplex was specifically manual input selected for that job by the operator. However, that alternative not only requires reprogramming of the machine, it wastes energy and paper by removing the automatic default to duplex copying for all other jobs in which duplex copying could be appropriate, i.e., where there is a print job of more than one page.

By way of background, there is noted e.g., Xerox Corp. U.S. Pat. Nos. 5,072,923; 5,026,044; 5,078,378; 5,337,135; 4,330,197; 4,459,013; and allowed U.S. Ser. No. 590,580 filed Sep. 28, 1990 (D/90366), on document input mode selections, and for a discussion of known document inputs and document handlers and duplex or simplex copiers, especially with recirculating document handlers.

A specific feature of the specific embodiment disclosed herein is to provide in a reproduction apparatus having plural different respective document inputs for inputting documents to be copied, including at least one document input normally used for copying single documents and another document input normally used for copying plural documents, said reproduction apparatus having a duplex copying path and providing a selection of simplex or duplex copying of documents from said document inputs onto one or both sides of copy sheets, respectively, the improvement comprising: an automatic system for automatically selecting duplex copying whenever appropriate, to save copy sheets, including; a controller programmed to automatically select between said simplex or duplex copying and connected to direct said copy sheets into said duplex copying path when said duplex copying is selected, respective document input sensors at said respective plural different document inputs connected to provide control signals to said controller upon sensing a document at said respective document input, said controller automatically selecting said duplex copying of said documents unless said document input sensor at a said document input normally used for copying single documents is providing a control signal to said controller upon sensing a document at said document input.

Further specific features disclosed herein, individually or in combination, include those wherein another document input normally used for copying plural documents has a second sensor providing a control signal to said controller for sensing that only a single document has been inputted there, and upon said second sensor providing such control signal, said controller automatically selects simplex copying of said single document; and/or wherein said another document input normally used for copying plural documents is the input tray of an automatic recirculating document handler unit; and/or said document inputs normally used for copying single documents comprise a semiautomatic document input to said automatic recirculating document handler unit, and a manual document input is provided by lifting said automatic recirculating document handler unit, for which said respective document input sensor is a sensor for sensing said lifting of said automatic recirculating document handler input unit.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software and computer arts. Alternatively, the disclosed control system or method may be implemented partially or fully in hardware, using standard logic circuits or single chip VLSI designs.

It is well known that the control of document and copy sheet handling systems may be accomplished by conventionally actuating them with signals from a microprocessor controller directly or indirectly in response to simple programmed commands, and/or from selected actuation or non-actuation of conventional switch inputs such as switches selecting the number of copies to be made in that job or run, selecting simplex or duplex copying, selecting a copy sheet supply tray, etc.. The resultant controller signals may conventionally actuate various conventional electrical solenoid or cam-controlled sheet deflector fingers, motors or clutches, or other components, in programmed steps or sequences. Conventional sheet path sensors or switches connected to the controller may be utilized for sensing, counting, and timing the positions of sheets in the sheet paths of the reproduction apparatus, and thereby also controlling the operation of sheet feeders and inverters, etc., as is well known in the art.

In the description herein the term "sheet" refers to a usually flimsy physical sheet of paper, plastic, or other suitable physical substrate for images, whether precut or web fed. A "copy sheet" may be abbreviated as a "copy", or called a "hardcopy". A "job" is normally a set of related sheets, usually a collated copy set copied from a set of original document sheets or electronic document page images, from a particular user, or otherwise related. A "simplex" document or copy sheet is one having its image and any page number on only one side or face of the sheet, whereas a "duplex" document or copy sheet has "pages", and normally images, on both sides, i.e., each duplex sheet is considered to have two opposing sides or "pages" even though no physical page number may be present.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Various of the above-mentioned and further features and advantages will be apparent from the specific apparatus and its operation described in the example below, and the claims. Thus, the present invention will be better understood from this description of a specific embodiment, including the drawing figure wherein:

FIG. 1 is a schematic frontal view of one embodiment of the disclosed system.

With the disclosed exemplary system, the (otherwise conventional and well known) copier 10 detects which document input device or path is being used by a triggering of its respective document input sensor by a document or documents being inserted into that particular document input. Here, these are the known sensors 12 and 22 for the document input to the recirculating document handler (RDH) unit tray 14, sensor 16 for the semiautomatic document input (SADH input 18), and sensor or switch 24 for the manual document placement on the platen 26 for copying.

Here, software in the copier controller 100 is operatively connected to the signals from these respective document input sensors and programmed to automatically select the appropriate (simplex or duplex) mode of operation, with duplex copying automatically selected only where appropriate, based on the following algorithm: If no operator switch selection input at GUI 110 or otherwise has indicated to the controller 100 that this original was a duplex document, and if the sensed document input is manual platen copying (which can be sensed by the document cover switch 24, signaling that the RDH unit is lifted, as shown in phantom), OR if the document input is sensed by actuation of sensor 16 at the SADH input 18, then the copying mode is temporarily set, for that job only, to simplex/simplex, and thus the copy sheet is outputted at output 30 after being printed on only one side, not fed back through the duplex path 40 via duplex gate 42 actuation. If the RDH tray 14 input switch 12 is triggered by the documents loaded by the operator into the RDH tray 14, the system selection in controller 100 is set or remains in a pre-programmed automatic duplex copying mode, except that after initial feeding of the first document from the RDH tray 14, if the RDH input path sensor 22 at the RDH tray 14 feeder output senses that only a single sheet was fed, (i.e., there is no second sheet), then for that print job the copying mode is set to simplex copying. Otherwise, the system desirably remains in a duplex copying mode, and the first side printed copy sheets from that document set are appropriately fed into the duplex path 40 by gate 42 for their second side printing rather than outputted immediately. The duplex path 40 and its operation with the RDH for duplex copying is well known and need not be described in detail herein. E.g., various of the Xerox Corporation U.S. patents cited above.

Examples of two potential user interfaces for this system are to provide either: (1) "pop up" windows (as is well known per se) on the CRT, LED or other conventional machine graphic user interface (GUI 110 here); or (2) to provide flashing LEDs as a GUI to inform the user of the copier's automatic change of "Sides Copied" mode from simplex to duplex. Thus, when a user approaches a copier with the subject features enabled, they may see, in these respective displays, either:

1) The copier GUI may display a customer selectable simplex or duplex "Sides Copied" setting, or an initial duplex default. This initial display setting may change (if necessary) upon selection of the document input device, as described, and a pop up window may notify the user if there is a setting change; or 2) The copier does not initially display any "Sides Copied" selection (All "Sides Copied" LEDs are initially extinguished). When a document input device is selected, the appropriate LED will flash next to a legend to notify the user of the selection being made. After the copying job, when the machine "times out", the "Sides Copied" will become undisplayed once again.

An optional or additional feature would be to allow the key operator or tech rep to be able to select (re-program) the "sides copied" default separately (differently) for each different document input device.

While the embodiment disclosed herein is preferred, it will be appreciated from this teaching that various alternatives, modifications, variations or improvements therein may be made by those skilled in the art, which are intended to be encompassed by the following claims:

I claim:

1. In a reproduction apparatus having plural different respective document inputs for inputting documents to be copied, including at least one document input normally used for copying single documents and another document input normally used for copying plural documents, said reproduction apparatus having a duplex copying path and providing a selection of simplex or duplex copying of documents from said document inputs onto one or both sides of copy sheets, respectively, the improvement comprising:

an automatic system for automatically selecting duplex copying whenever appropriate, to save copy sheets, including;

a controller programmed to automatically select between said simplex or duplex copying and connected to direct said copy sheets into said duplex copying path when said duplex copying is selected, respective document input sensors at said respective plural different document inputs connected to provide control signals to said controller upon sensing a document at said respective document input, said controller automatically selecting said duplex copying of said documents unless said document input sensor at a said document input normally used for copying single documents is providing a control signal to said controller upon sensing a document at said document input;

wherein said another document input normally used for copying plural documents is the input tray of an automatic recirculating document handler unit, and said document inputs normally used for copying single documents comprise a semiautomatic document input to said automatic recirculating document handler unit, and a manual document input provided by lifting said automatic recirculating document handler unit for which said respective document input sensor is a sensor for sensing said lifting of said automatic recirculating document handler unit.

2. The reproduction apparatus of claim 1 wherein said another document input normally used for copying plural documents has a second sensor providing a control signal to said controller for sensing that only a single document has been inputted there, and upon said second sensor providing such control signal, said controller automatically selects simplex copying of said single document.

* * * * *